US009161872B2

(12) United States Patent
Lee et al.

(10) Patent No.: US 9,161,872 B2
(45) Date of Patent: Oct. 20, 2015

(54) GAIT REHABILITATION MACHINE AND METHOD OF USING THE SAME

(75) Inventors: Shin-Da Lee, Taichung (TW); Wen-Chia Wu, Taichung (TW); Wen-Bin Lin, Taichung (TW)

(73) Assignee: Hwin Technologies Corp., Taichung (TW)

( * ) Notice: Subject to any disclaimer, the term of this patent is extended or adjusted under 35 U.S.C. 154(b) by 702 days.

(21) Appl. No.: 13/427,456

(22) Filed: Mar. 22, 2012

(65) Prior Publication Data

US 2012/0253242 A1 Oct. 4, 2012

(30) Foreign Application Priority Data

Mar. 31, 2011 (TW) ..... 100111254 A

(51) Int. Cl.

| | |
|---|---|
| ***A61H 1/00*** | (2006.01) |
| ***A61H 1/02*** | (2006.01) |
| ***A61G 7/10*** | (2006.01) |
| *A61G 5/14* | (2006.01) |

(52) U.S. Cl.

CPC ..... *A61G 7/1015* (2013.01); *A61H 1/0262* (2013.01); *A61G 5/14* (2013.01); *A61G 7/1051* (2013.01); *A61G 7/1088* (2013.01); *A61G 2200/34* (2013.01); *A61G 2200/36* (2013.01); *A61H 2201/1246* (2013.01); *A61H 2201/149* (2013.01); *A61H 2201/1642* (2013.01); *A61H 2201/1666* (2013.01)

(58) Field of Classification Search

CPC ..... A61H 1/00; A61H 1/005; A61H 1/02; A61H 1/0255; A61H 1/0237; A61H 1/0244; A61H 1/0259; A61H 1/0262; A61H 1/0266; A61G 7/00; A61G 7/1015

USPC ..... 601/5, 23, 33–35

See application file for complete search history.

(56) References Cited

U.S. PATENT DOCUMENTS

| | | | | |
|---|---|---|---|---|
| 5,814,000 | A * | 9/1998 | Kilbey | 602/16 |
| 6,146,315 | A | 11/2000 | Schönenberger | |
| 6,780,142 | B1 * | 8/2004 | Takizawa et al. | 482/8 |
| 6,821,233 | B1 | 11/2004 | Colombo et al. | |
| 7,938,756 | B2 * | 5/2011 | Rodetsky et al. | 482/69 |
| 2002/0026130 | A1 * | 2/2002 | West | 601/23 |
| 2007/0219069 | A1 * | 9/2007 | Nativ | 482/69 |
| 2008/0234113 | A1 * | 9/2008 | Einav | 482/66 |
| 2008/0255488 | A1 * | 10/2008 | Agrawal et al. | 602/23 |
| 2010/0222716 | A1 * | 9/2010 | Olsen | 601/26 |

* cited by examiner

*Primary Examiner* — Justine Yu
*Assistant Examiner* — Kathrynn Reilly
(74) *Attorney, Agent, or Firm* — Muncy, Geissler, Olds & Lowe, P.C.

(57) ABSTRACT

A gait rehabilitation machine and a method of using the same for lower-limb rehabilitation. The gait rehabilitation machine includes: a frame; a rear supporting member provided at the frame so that the back side of a human body can lean against the rear supporting member; a thigh supporting member corresponding to a thigh of the human body and pivotally connected to the frame; a shank supporting member corresponding to the corresponding shank of the human body, pivotally connected to the thigh supporting member, and having a pedal to be stepped on by the human body; a knee supporting member corresponding to the corresponding knee of the human body and provided at the thigh supporting member or the shank supporting member; and a transmission device for driving the shank supporting member to move. Thus, a patient can do lower-limb gait rehabilitation exercise without using a suspension system.

18 Claims, 21 Drawing Sheets

GAIT REHABILITATION MACHINE AND METHOD OF USING THE SAME

BACKGROUND OF THE INVENTION

1. Technical Field

The present invention relates to rehabilitation apparatuses and, more particularly, to a gait rehabilitation machine for assisting in a patient's gait rehabilitation and a method of using the gait rehabilitation machine.

2. Description of Related Art

People with paraplegia resulting from spinal cord injuries, strokes, nerve injuries, etc. rely on medical assistive apparatuses in their daily lives not only to move and position their bodies but also to assist in rehabilitation. Typically, the purpose of rehabilitative exercise is to restore patients' mobility. In restoring a patient's walking ability for example, assistive apparatuses for gait rehabilitation play a very important role.

The structure of commercially available assistive gait rehabilitation apparatuses, such as those based on U.S. Pat. No. 6,146,315 and U.S. Pat. No. 6,821,233, mainly includes a suspension system for suspending a patient so that the patient is standing on a treadmill and ready to do gait rehabilitation exercise. As the patient's body must be suspended on the suspension system for a long time to stay in the standing position required by the rehabilitative exercise, bodily discomfort tends to ensue. Besides, it is a time-consuming process for the patient to suspend his or her own body onto the suspension system. Those who help the patient put on or take off the gears must also be properly trained in order to assist the patient in getting on or off the suspension system safely. Moreover, an assistive gait rehabilitation apparatus composed of a treadmill and an ancillary suspension system has a very large volume and, although the operating speed of the treadmill can be controlled to provide walking exercises at different paces, does not allow postural adjustment of the patient's lower limbs; consequently, the training effect on the lower limbs leaves much to be desired.

BRIEF SUMMARY OF THE INVENTION

The primary object of the present invention is to provide a gait rehabilitation machine which allows a patient to do gait rehabilitation exercise without having to be suspended for a long time.

To achieve the foregoing primary object, the present invention provides a gait rehabilitation machine for rehabilitating a patient's lower limbs. The gait rehabilitation machine includes: a frame; a rear supporting member provided at the frame so that the back side of a human body can lean against the rear supporting member; a thigh supporting member corresponding to a thigh of the human body and pivotally connected to the frame; a shank supporting member corresponding to the corresponding shank of the human body and pivotally connected to the thigh supporting member, wherein the shank supporting member has a pedal to be stepped on by the human body; a knee supporting member corresponding to the corresponding knee of the human body and provided at the thigh supporting member or the shank supporting member; and a transmission device for driving the shank supporting member to move.

The present invention also provides a method of using a gait rehabilitation machine, wherein the gait rehabilitation machine includes: a frame; a rear supporting member provided at the frame so that the back side of a human body can lean against the rear supporting member; a thigh supporting member corresponding to a thigh of the human and pivotally connected to the frame; a shank supporting member corresponding to the corresponding shank of the human body and pivotally connected to the thigh supporting member, wherein the shank supporting member has a pedal to be stepped on by the human body; a knee supporting member corresponding to the corresponding knee of the human body and provided at the thigh supporting member or the shank supporting member; a transmission device for driving the shank supporting member to move; and a reeling device in which a winding element is wound and which can increase or decrease the exposed length of the winding element. The method of using the gait rehabilitation machine includes the following steps:

A) Shank positioning: A wheelchair-ridden patient enters the gait rehabilitation machine on his or her own or with external help. Then, the sole of one of the patient's feet is placed on the pedal, and the corresponding shank is placed on the shank supporting member.

B) Thigh positioning: By controlling the reeling device, the winding element is wound around the patient's body. Then, the reeling device is controlled to shorten the exposed length of the winding element such that the patient is driven by the winding element to stand on the shank supporting member, with the corresponding thigh corresponding to the thigh supporting member, and the corresponding knee corresponding to the knee supporting member. In addition, the rear supporting member is installed onto the frame, allowing the patient to lean his or her back side against the rear supporting member.

C) Rehabilitative exercise: The transmission device is operated to drive the shank supporting member into motion; consequently, the patient is engaged in gait rehabilitation exercise.

Thus, the patient only has to step on the shank supporting member, with the corresponding knee pressing against the knee supporting member and corresponding thigh abutting against the thigh supporting member, and lower-limb gait rehabilitation exercise can be carried out in the absence of a suspension system.

BRIEF DESCRIPTION OF THE SEVERAL VIEWS OF THE DRAWINGS

The structure as well as a preferred mode of use, further objects, and advantages of the present invention will be best understood by referring to the following detailed description of some illustrative embodiments in conjunction with the accompanying drawings, in which.

DETAILED DESCRIPTION OF THE INVENTION

The technical features of the present invention are detailed below with reference to the preferred embodiments in conjunction with the accompanying drawings.

Figure 1:
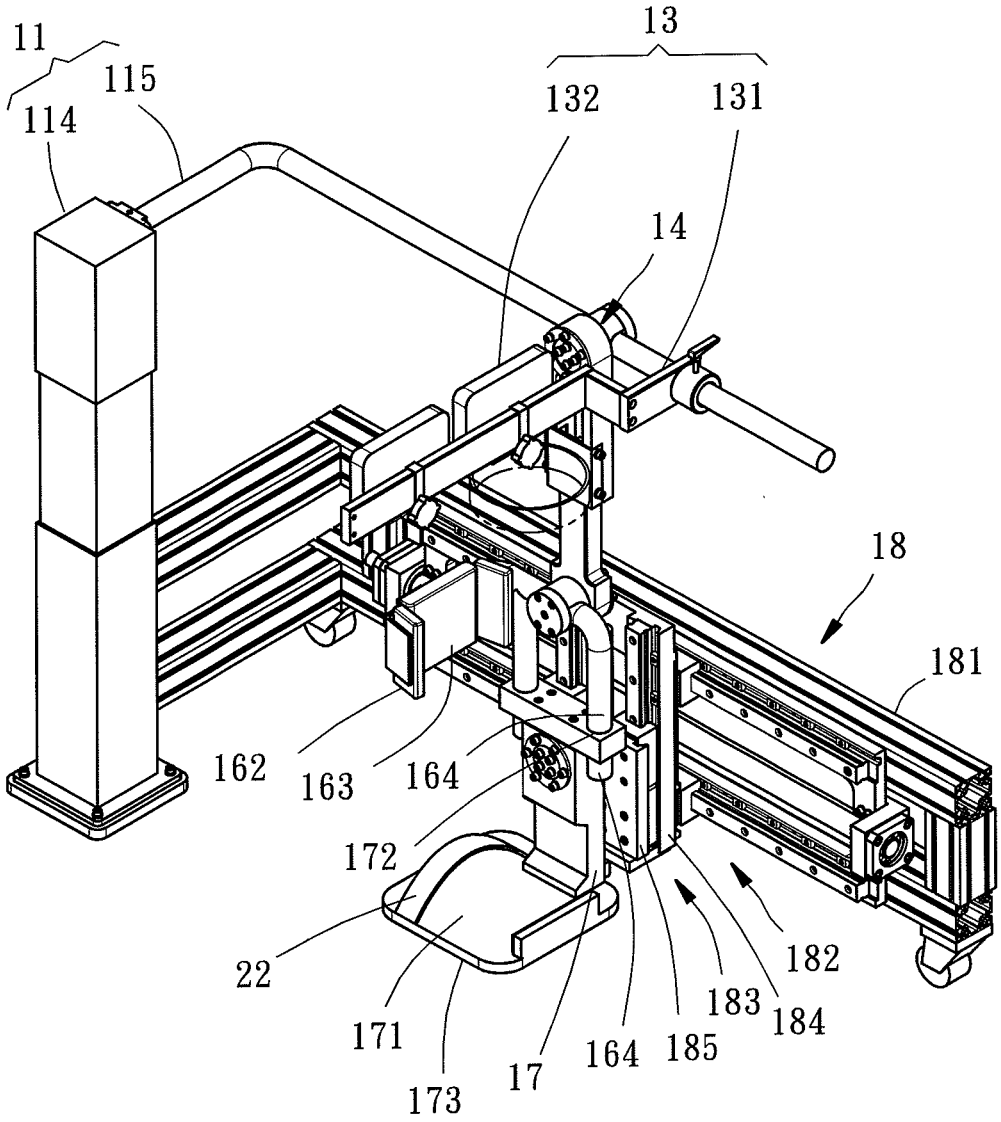
FIG. 1 is a perspective view of the gait rehabilitation machine in the first preferred embodiment of the present invention.
Figure 2:
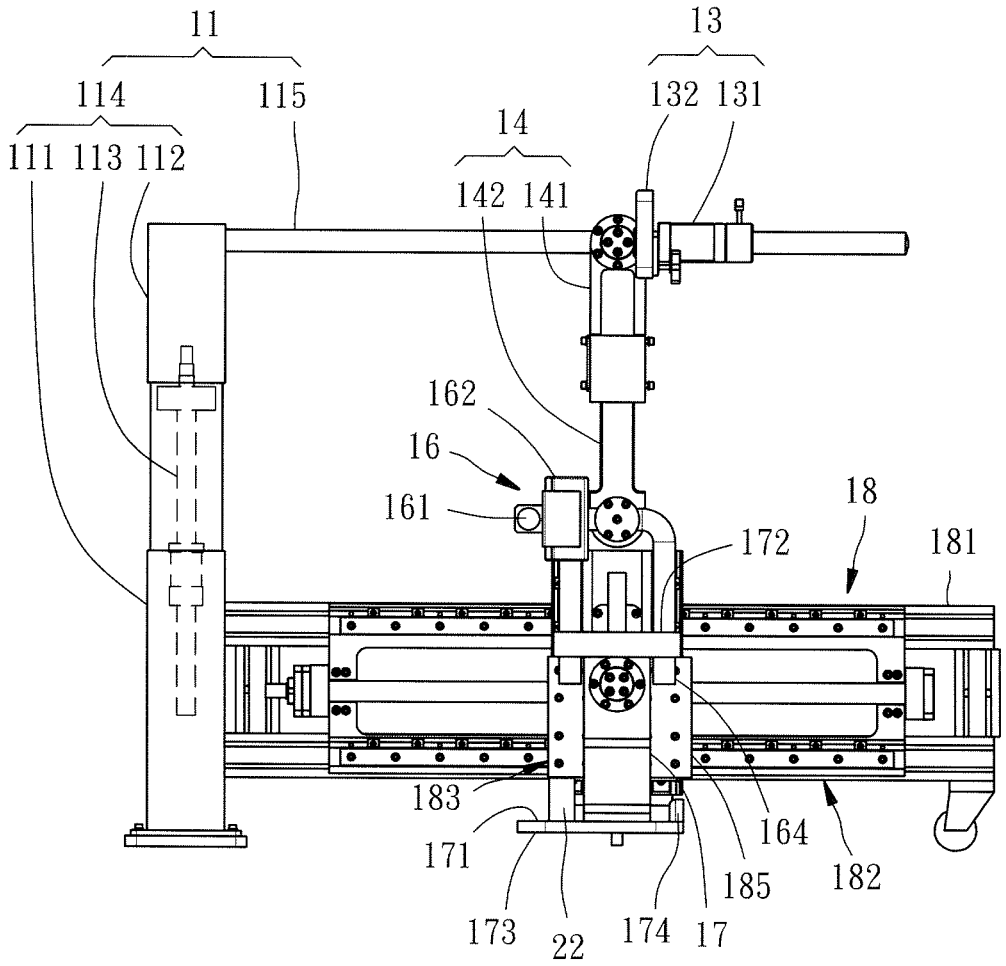
FIG. 2 is a side elevation view of the gait rehabilitation machine in the first preferred embodiment of the present invention.
Figure 3:
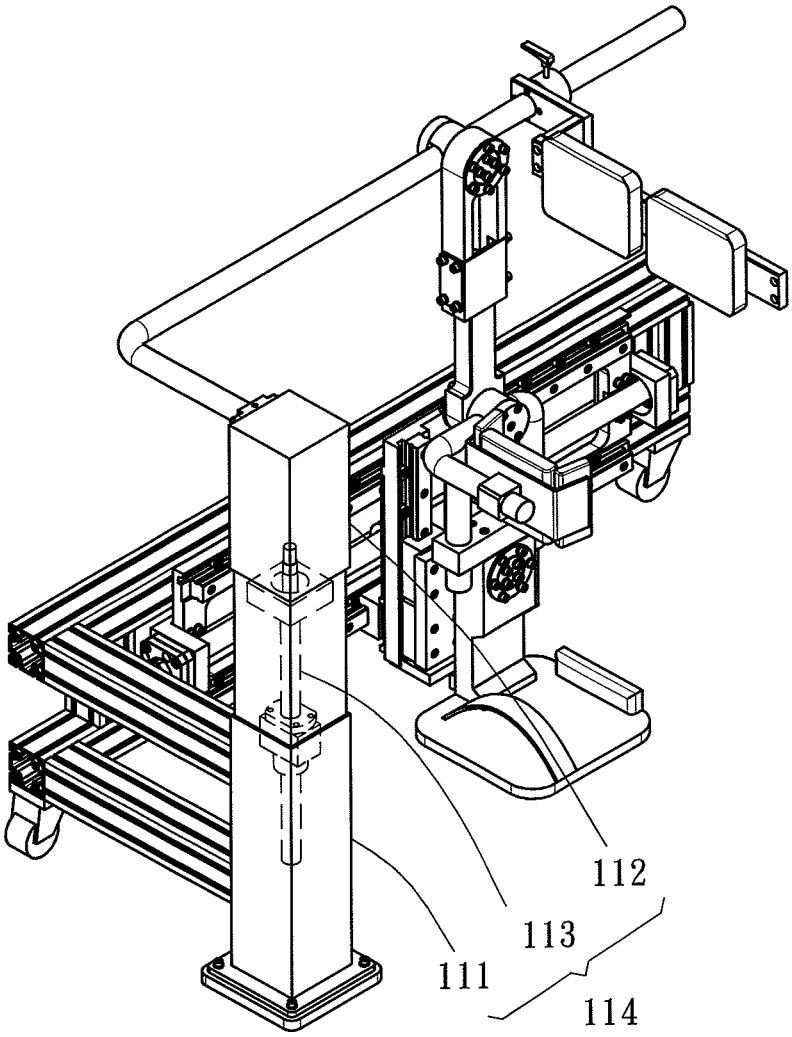
FIG. 3 schematically shows the post in the first preferred embodiment of the present invention, wherein the post includes a fixed element, a movable element, and a lifting unit.

Referring to FIG. 1 to FIG. 3, the first preferred embodiment of the present invention provides a gait rehabilitation machine which essentially includes: a frame 11, a rear supporting member 13, a thigh supporting member 14, a shank supporting member 17, a knee supporting member 16, and a transmission device 18.

The rear supporting member 13 is provided at the frame 11 so as for the back side of a human body to lean against the rear supporting member 13. The thigh supporting member 14 corresponds to one thigh of the human body and is pivotally connected to the frame 11. The shank supporting member 17 corresponds to the corresponding shank of the human body and is pivotally connected to the thigh supporting member 14. The shank supporting member 17 has a pedal 171 on which the human body can step. The knee supporting member 16 corresponds to the corresponding knee of the human body and is provided either at the thigh supporting member 14 or at the shank supporting member 17. The transmission device 18 is configured for driving the shank supporting member 17 to move.

Referring again to FIG. 1 to FIG. 3, in the first preferred embodiment, the frame 11 has a post 114 and a handrail 115. The bottom portion of the post 114 is fixed on the ground or an object. The handrail 115 has one end fixedly connected to the post 114 while the other end is a free end. As shown in FIG. 3, the post 114 has a fixed element 111, a movable element 112, and a lifting unit 113. The fixed element 111 is provided on the aforesaid object or the ground. The movable element 112 is movably connected to the fixed element 111 and fixedly connected to the handrail 115. The lifting unit 113 is fixedly connected to each of the fixed element 111 and the movable element 112 and is configured for increasing or decreasing the distance between the fixed element 111 and the movable element 112. It should be pointed out that the lifting unit 113 can be a bolt-and-nut assembly or a hydraulic cylinder and is shown in this preferred embodiment as a bolt-and-nut assembly. By operating the lifting unit 113, the distance between the fixed element 111 and the movable element 112 can be adjusted, thereby adjusting the overall height of the frame 11.

The rear supporting member 13 is fixedly and detachably connected to the frame 11 so that the back side of the human body (e.g., the portion between the waist and buttocks) can lean against the rear supporting member 13. In this embodiment, the rear supporting member 13 has a fixed bracket 131 and a supporting pad 132. The fixed bracket 131 is detachably connected to the handrail 115 of the frame 11. The supporting pad 132 is fixedly provided on the fixed bracket 131 and is configured for supporting the back side of the human body. In other words, the back side of the human body can lean against the supporting pad 132. In this preferred embodiment, the supporting pad 132 is made of a soft material to provide a comfortable feel to the human body.

In this embodiment, the thigh supporting member 14 has a first section 141 and a second section 142. The first section 141 is pivotally connected to the handrail 115 of the frame 11, and the second section 142 is movably connected to the first section 141. More specifically, the first section 141 is mounted around the second section 142. By moving the first section 141 and the second section 142 relative to each other, the distance therebetween can be adjusted so that the thigh supporting member 14 is adjusted to correspond to the size of the corresponding thigh of the human body.

The shank supporting member 17 corresponds to the corresponding shank of the human body and is provided on the frame 11. The shank supporting member 17 has a pedal 171 to be stepped on by the human body. In this embodiment, the shank supporting member 17 is movably connected to the knee supporting member 16 and has a flat plate portion 173. The pedal 171 to be stepped on is formed by the flat plate portion 173. It should be pointed out that, in this embodiment, the knee supporting member 16 has a guide post 164, and the shank supporting member 17 has a guide hole 172 corresponding to the guide post 164, wherein the guide post 164 is inserted in the guide hole 172 to limit relative movement between the knee supporting member 16 and the shank supporting member 17. In addition, the rear side of the flat plate portion 173 is protrudingly provided with a stop block 174. A strap 22 is provided at the flat plate portion 173 and in front of the stop block 174. Thus, when one of a patient's feet is placed on the pedal 171, the foot can be inserted in between the strap 22 and the flat plate portion 173 such that the stop block 174 abuts against the heel. This prevents the foot from coming off the flat plate portion 173 and thereby enhances safety in use.

It should be noted that, while the strap 22 in this preferred embodiment is provided at the flat plate portion 173, it is also feasible to have the strap 22 provided on the thigh supporting member 14, as shown by the dashed line in FIG. 1, so as to secure the thigh in place. The provision of the strap 22 at the flat plate portion 173 and the provision of the strap 22 on the thigh supporting member 14 are independent of each other; in other words, either or both of the straps 22 can be provided.

The knee supporting member 16 corresponds to the corresponding knee of the human body and is provided at the thigh supporting member 14 or the shank supporting member 17. In this embodiment, the knee supporting member 16 is pivotally connected to the thigh supporting member 14, or more particularly to the second section 142 of the thigh supporting member 14. The knee supporting member 16 has an abutting portion 161 against which the corresponding knee of the human body can abut. In addition, the present embodiment includes a position-limiting element 162 fixedly provided at the abutting portion 161. The position-limiting element 162 has a position-limiting groove 163 corresponding to the corresponding knee of the human body. The knee can be located in the position-limiting groove 163 and have its moving direction limited by the position-limiting groove 163.

The transmission device 18 is configured for driving the shank supporting member 17 into motion. In this embodiment, the transmission device 18 has a base 181, a lateral movement device 182, and a vertical movement device 183.

The base 181 is provided beside the frame 11. The lateral movement device 182 is provided at the base 181 and between the base 181 and the frame 11. The lateral movement device 182 has a lateral movement platform 184 which can move laterally. The vertical movement device 183 is provided at the lateral movement platform 184 and has a vertical movement platform 185 which can move up and down. The vertical movement platform 185 is pivotally connected to the shank supporting member 17 so as to drive the shank supporting member 17 to move.

By simultaneously controlling the lateral movement device 182 and the vertical movement device 183, the vertical movement platform 185 is moved in conjunction with the lateral movement platform 184 to drive the shank supporting member 17 into motion. Thus, the gait path of the gait rehabilitation machine can be actively controlled, and the exercise posture of a patient's lower limbs is adjustable. Consequently, the problem of having a fixed lower-limb moving pattern as is typical of the conventional assistive gait rehabilitation apparatuses is solved. It should be pointed out that the transmission function of the transmission device 18 is equally achievable by other devices, such as elliptical trainers or like gait training machines; however, the lateral and vertical movement paths of such gait training machines are invariable.

Figure 4:
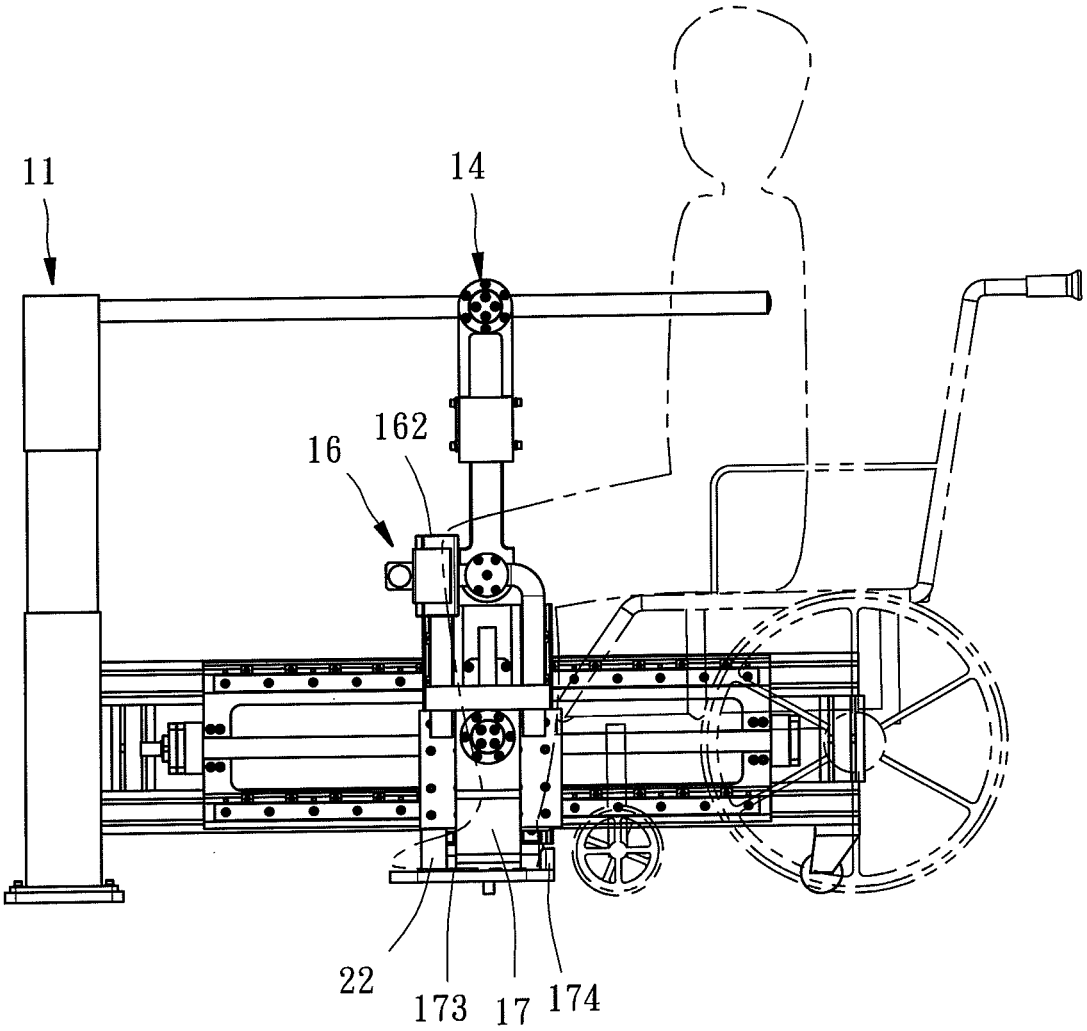
FIG. 4 schematically shows the first preferred embodiment of the present invention in use, wherein a patient has moved to the gait rehabilitation machine, put one of his or her shanks on the shank supporting member, and adjusted the relative positions of the shank supporting member and the knee supporting member in accordance with the size of the patient's shank.
Figure 5:
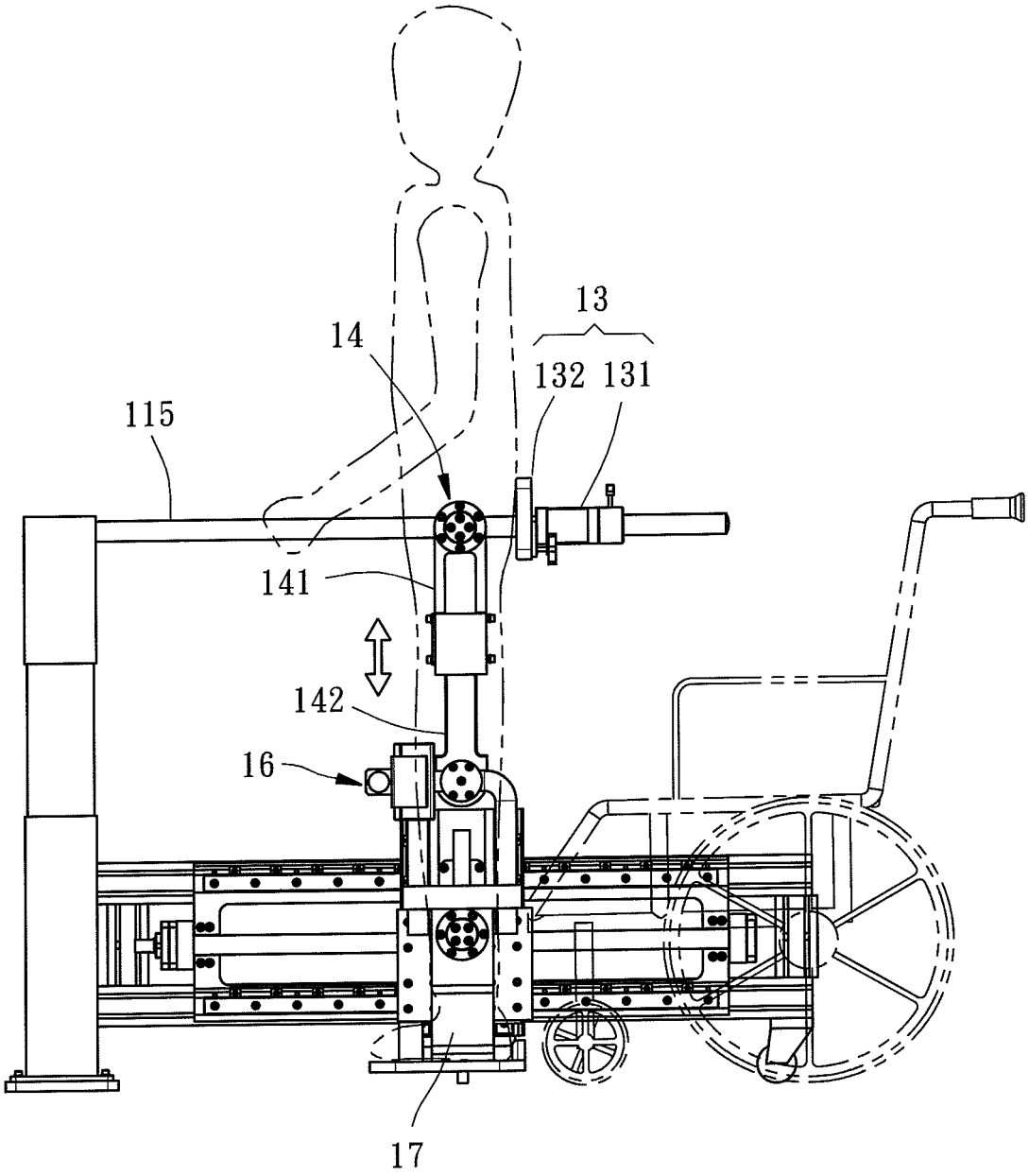
FIG. 5 is another schematic view showing the first preferred embodiment of the present invention in use, wherein the patient is standing on the shank supporting member, and the relative positions of a first section and a second section are adjusted so as for the thigh supporting member to fit the size of the patient's thigh.

The method of using the gait rehabilitation machine in the first preferred embodiment is now described with reference to FIG. 4 and FIG. 5. Before using the gait rehabilitation machine, the rear supporting member 13 is removed to allow a patient to move to the gait rehabilitation machine. Once the patient has moved to the gait rehabilitation machine, one of the patient's shanks is placed on the shank supporting member 17, with the corresponding foot resting on the pedal 171. More particularly, the foot is inserted in between the strap 22 and the flat plate portion 173 such that the stop block 174 abuts against the heel. Following that, the lifting unit 113 is operated to adjust the relative positions of the fixed element 111 and the movable element 112, allowing the distance between the shank supporting member 17 and the knee supporting member 16 to correspond to the size of the shank, and the corresponding knee to fit in and abut against the position-limiting groove 163 of the position-limiting element 162. Then, holding the handrail 115, the patient stands on the shank supporting member 17, with the corresponding thigh corresponding to the thigh supporting member 14, and the corresponding knee corresponding to the knee supporting member 16. Afterward, the lifting unit 113 is operated again to adjust the relative positions of the first section 141 and the second section 142, allowing the thigh supporting member 14 to conform to the size of the patient's thigh. Last but not least, the rear supporting member 13 is put in place, and the transmission device 18 is operated to drive the shank supporting member 17 into motion such that the patient begins gait rehabilitation exercise.

According to the aforesaid structure, the present invention enables a patient to do gait rehabilitation exercise without having to be suspended for a long time. Thus, not only is the discomfort resulting from long-term suspension eliminated, but also the space occupied by the gait rehabilitation machine is reduced due to the omission of the suspension system typically required in the conventional assistive gait rehabilitation apparatuses.

Figure 6:
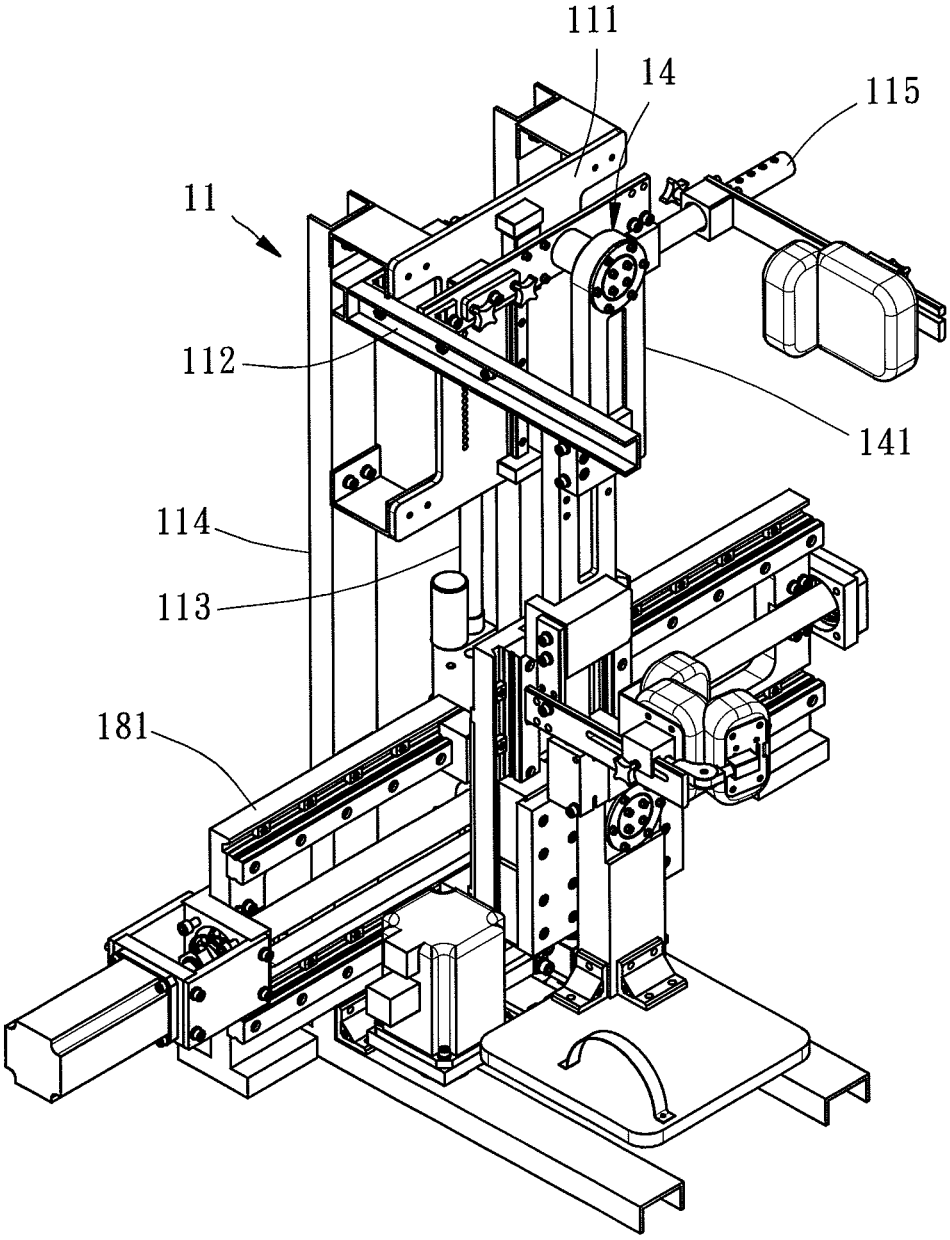
FIG. 6 is a perspective view of the gait rehabilitation machine in the second preferred embodiment of the present invention.
Figure 7:
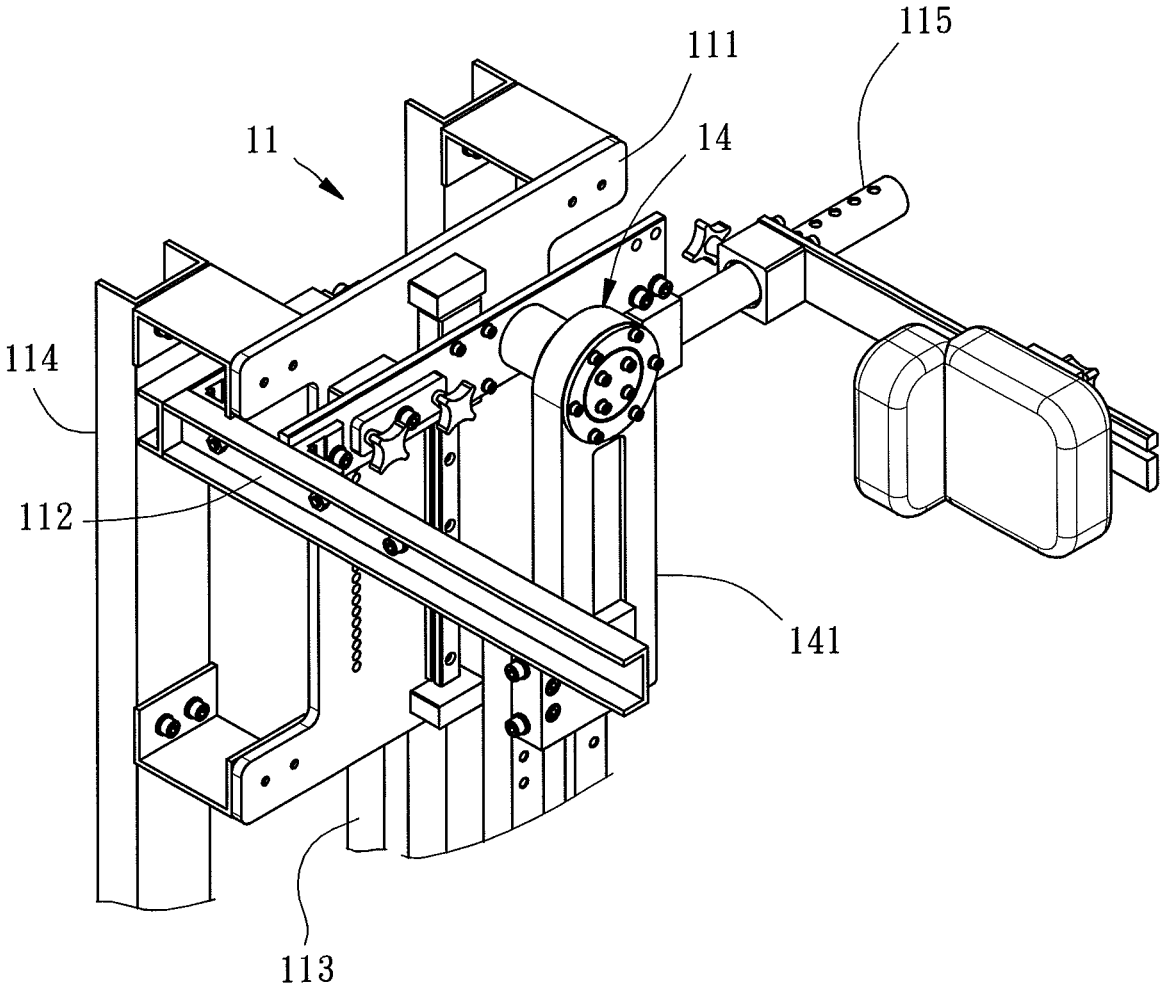
FIG. 7 is an enlarged view of the gait rehabilitation machine in the second preferred embodiment of the present invention.
Figure 8:
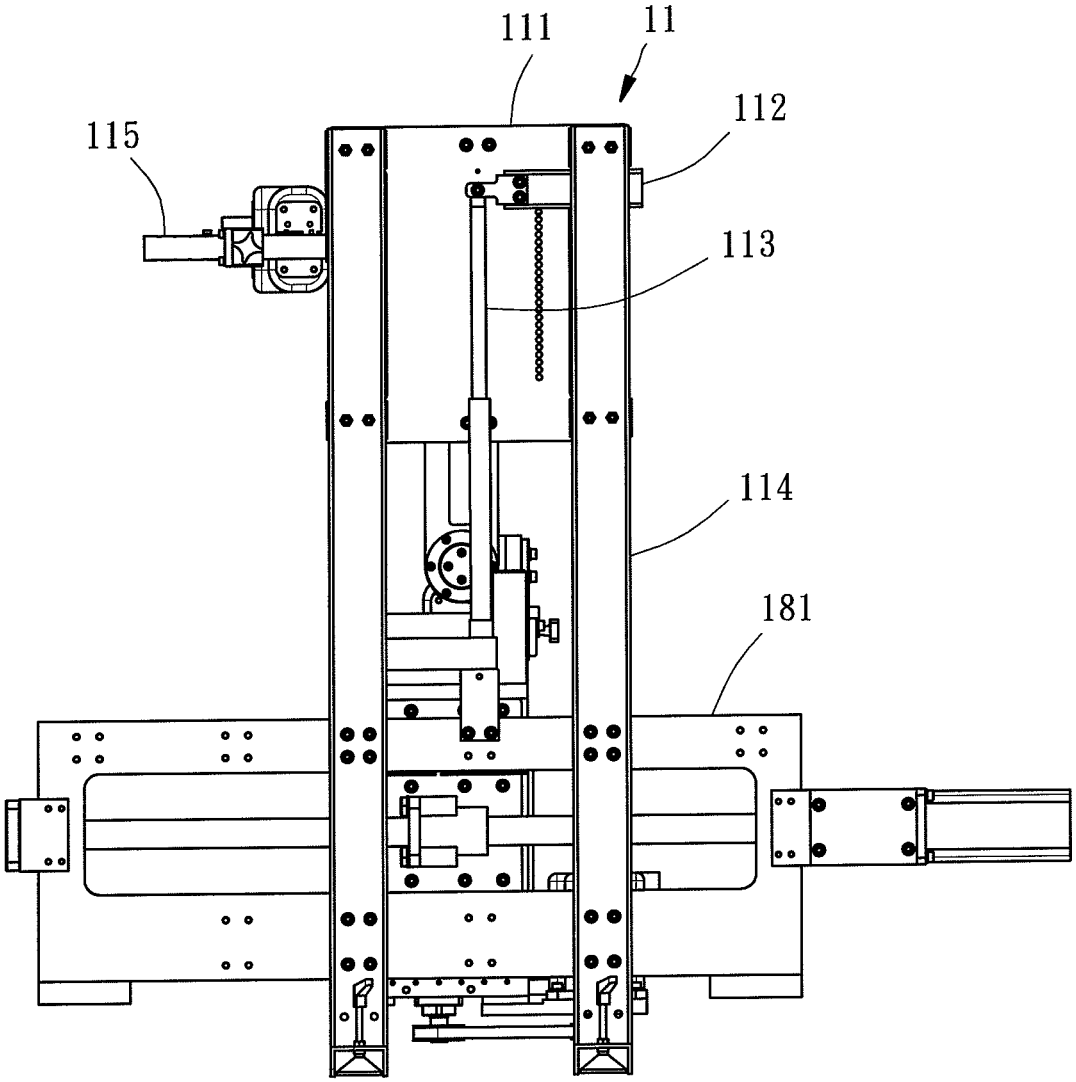
FIG. 8 is a side elevation view of the gait rehabilitation machine in the second preferred embodiment of the present invention.

FIG. 6 through FIG. 8 show the gait rehabilitation machine provided by the second preferred embodiment of the present invention. This gait rehabilitation machine is substantially the same as its counterpart in the first preferred embodiment in that the frame 11 has the post 114, the fixed element 111, the movable element 112, the lifting unit 113, and the handrail 115. In the second preferred embodiment, however, the post 114 is fixedly provided at the base 181, the fixed element 111 is fixedly provided at the post 114, the movable element 112 is movably connected to the fixed element 111, the lifting unit 113 is connected to each of the movable element 112 and the base 181 so as to increase or decrease the distance between the movable element 112 and the base 181, and the handrail 115 is fixedly and detachably connected to the movable element 112. Moreover, in the second preferred embodiment, the first section 141 of the thigh supporting member 14 is pivotally connected to the movable element 112. It should be pointed out that the lifting unit 113 can be a bolt-and-nut assembly or a hydraulic cylinder, the latter of which is used in this preferred embodiment by way of example.

The method of use of the second preferred embodiment is different from that of the first preferred embodiment in that, by operating the lifting unit 113, the distance between the movable element 112 and the base 181, and hence the height of the thigh supporting member 14, can be adjusted.

Figure 9:
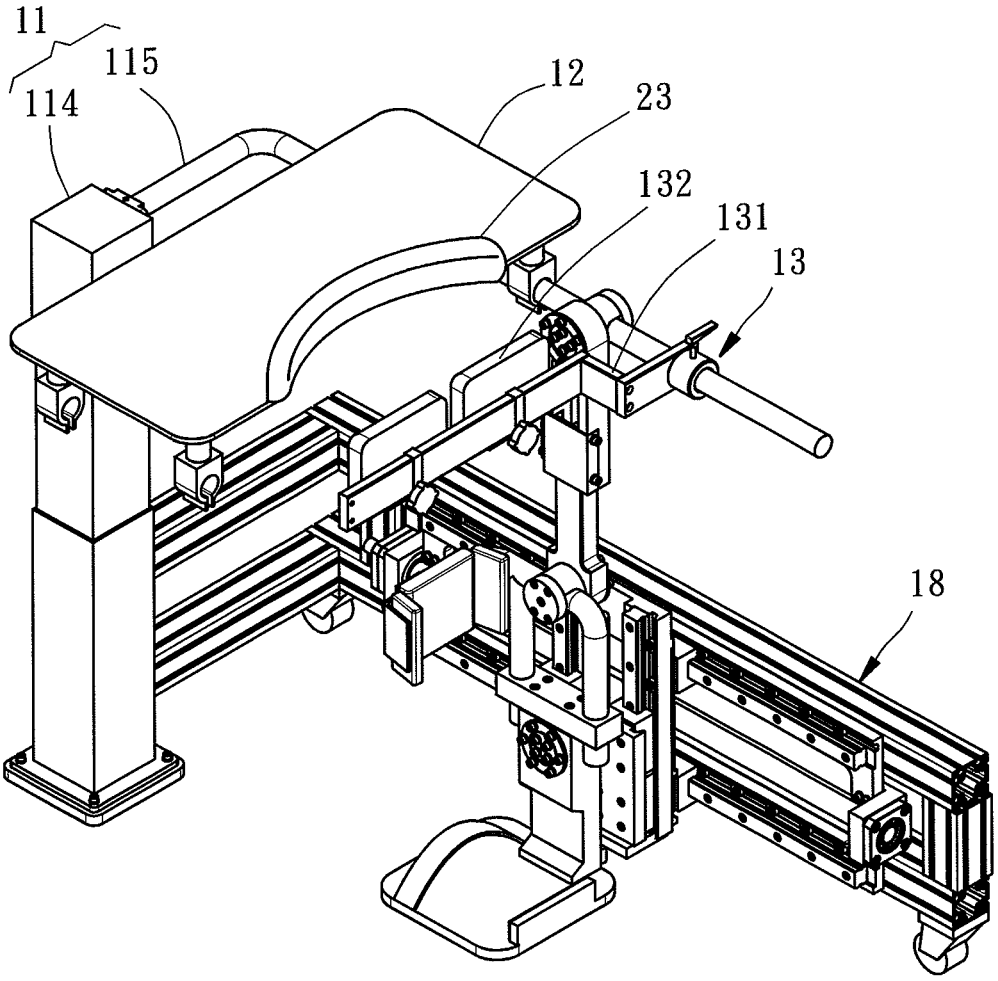
FIG. 9 is a perspective view of the gait rehabilitation machine in the third preferred embodiment of the present invention, wherein the gait rehabilitation machine includes a front supporting member.
Figure 10:
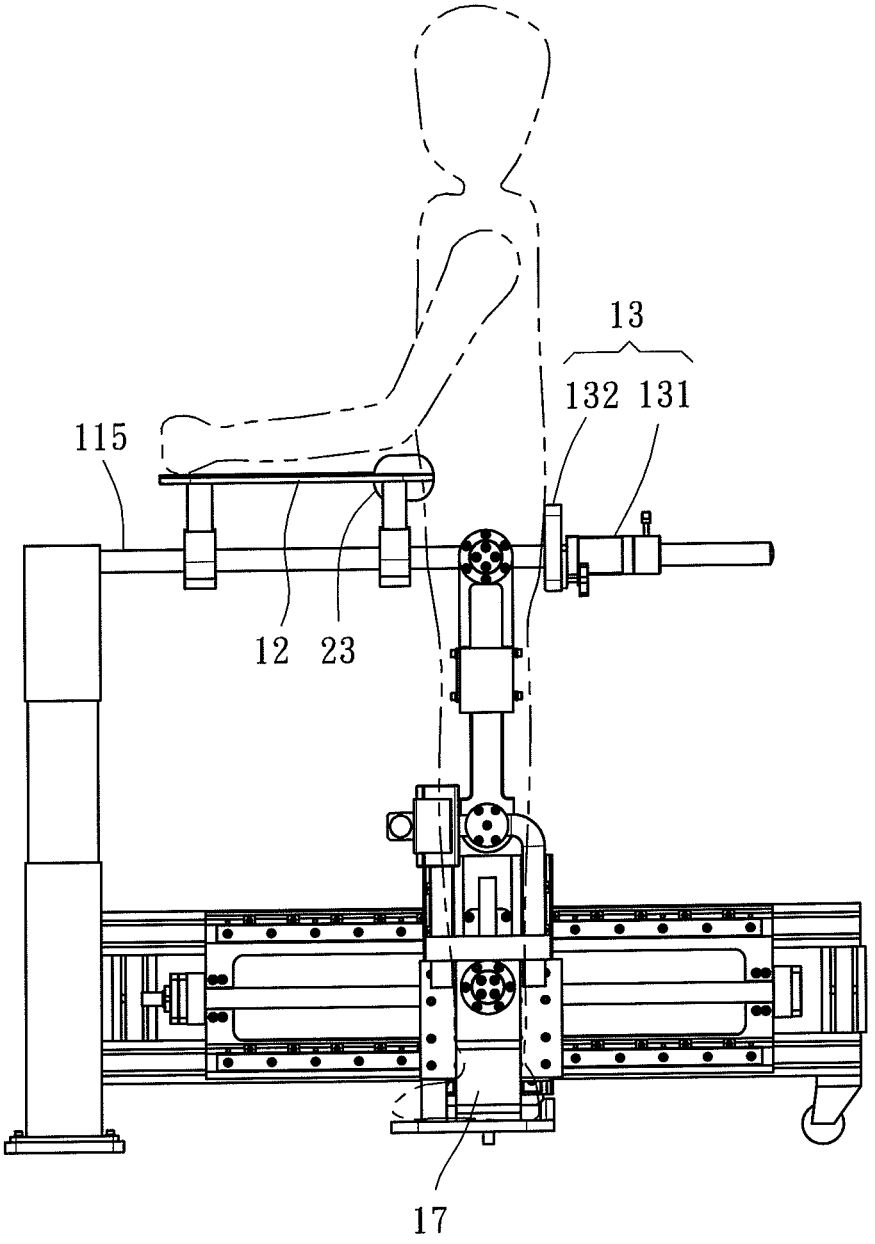
FIG. 10 schematically shows the third preferred embodiment of the present invention in use, wherein the front side of a patient's body leans against the front supporting member.
Figure 11:
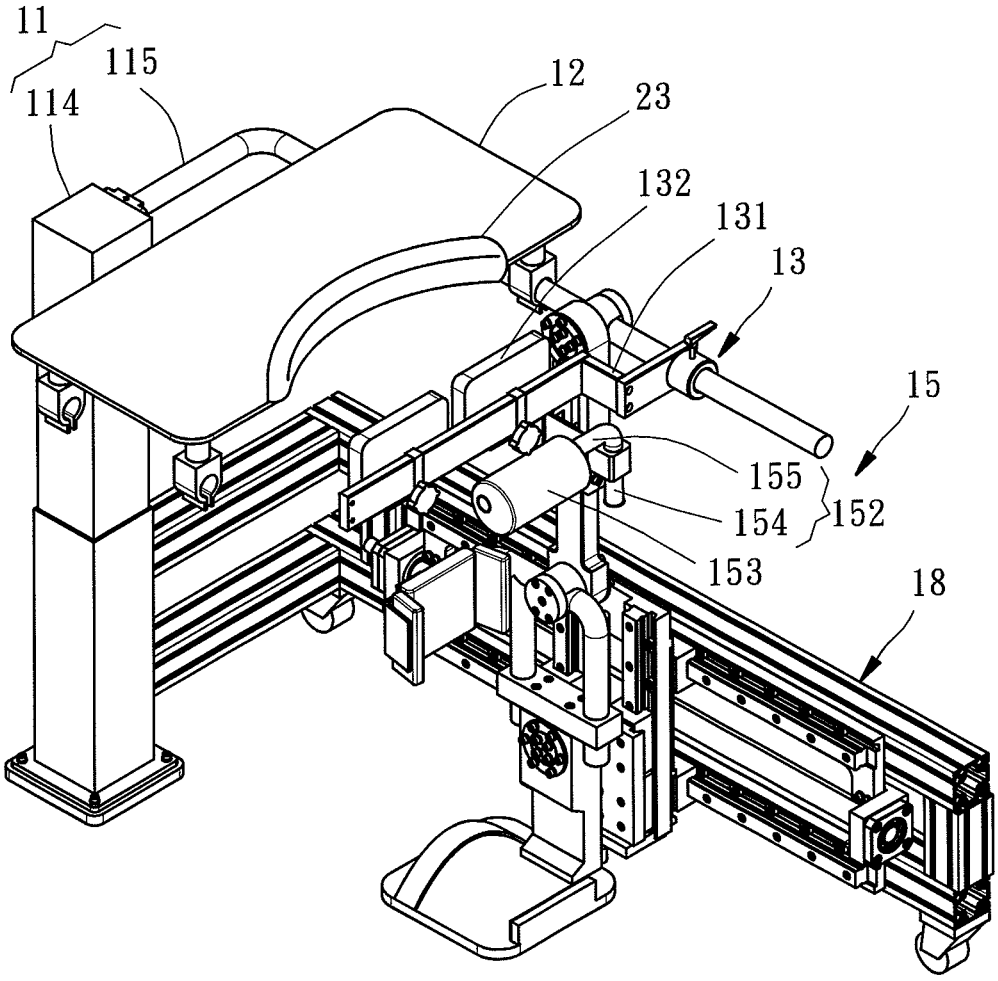
FIG. 11 is a perspective view of the gait rehabilitation machine in the fourth preferred embodiment of the present invention.
Figure 12:
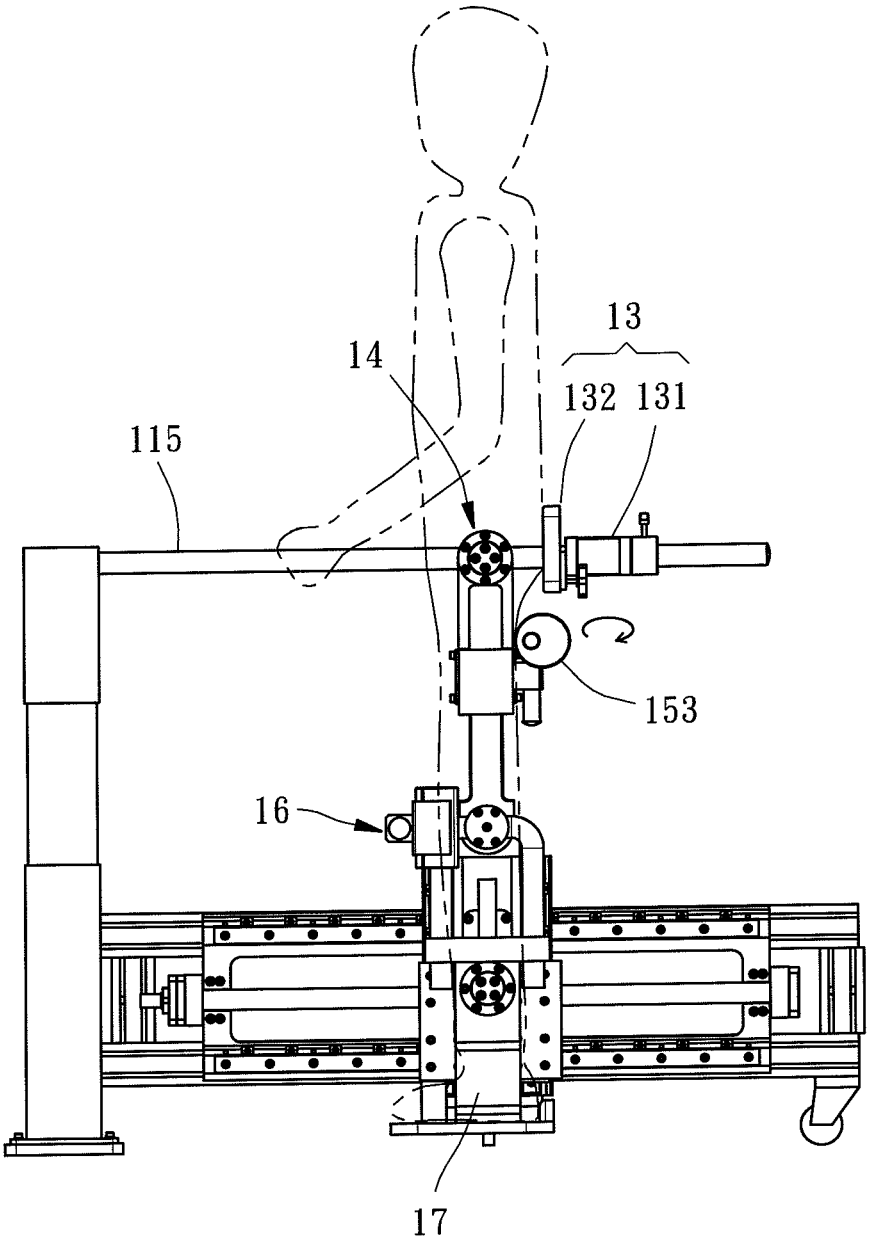
FIG. 12 schematically shows the fourth preferred embodiment of the present invention in use, wherein a thigh abutting member is provided between a patient's thighs and buttocks.
Figure 13:
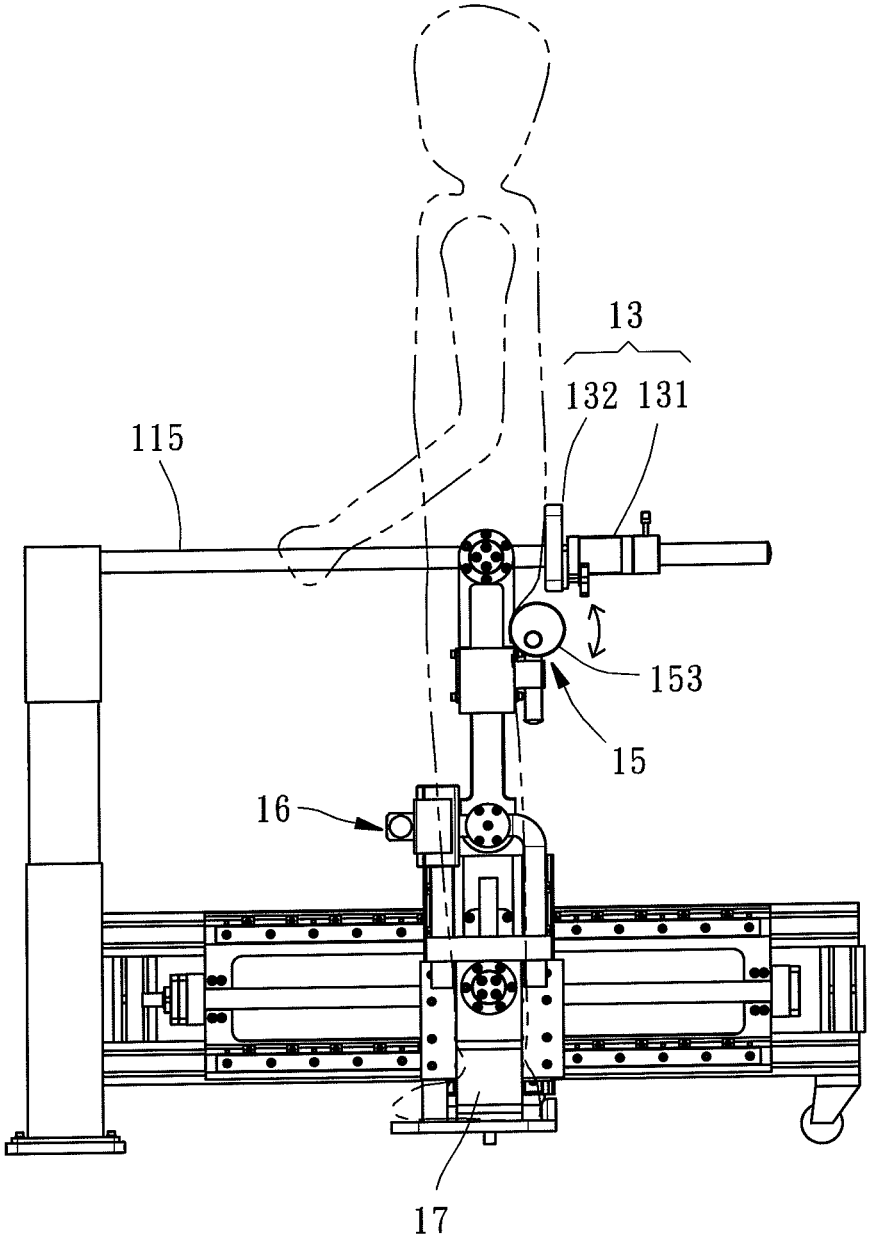
FIG. 13 is another schematic view showing the fourth preferred embodiment of the present invention in use, wherein a roller is rotated to adjust the tightness with which the thigh abutting member abuts against the patient's thigh.
Figure 14:
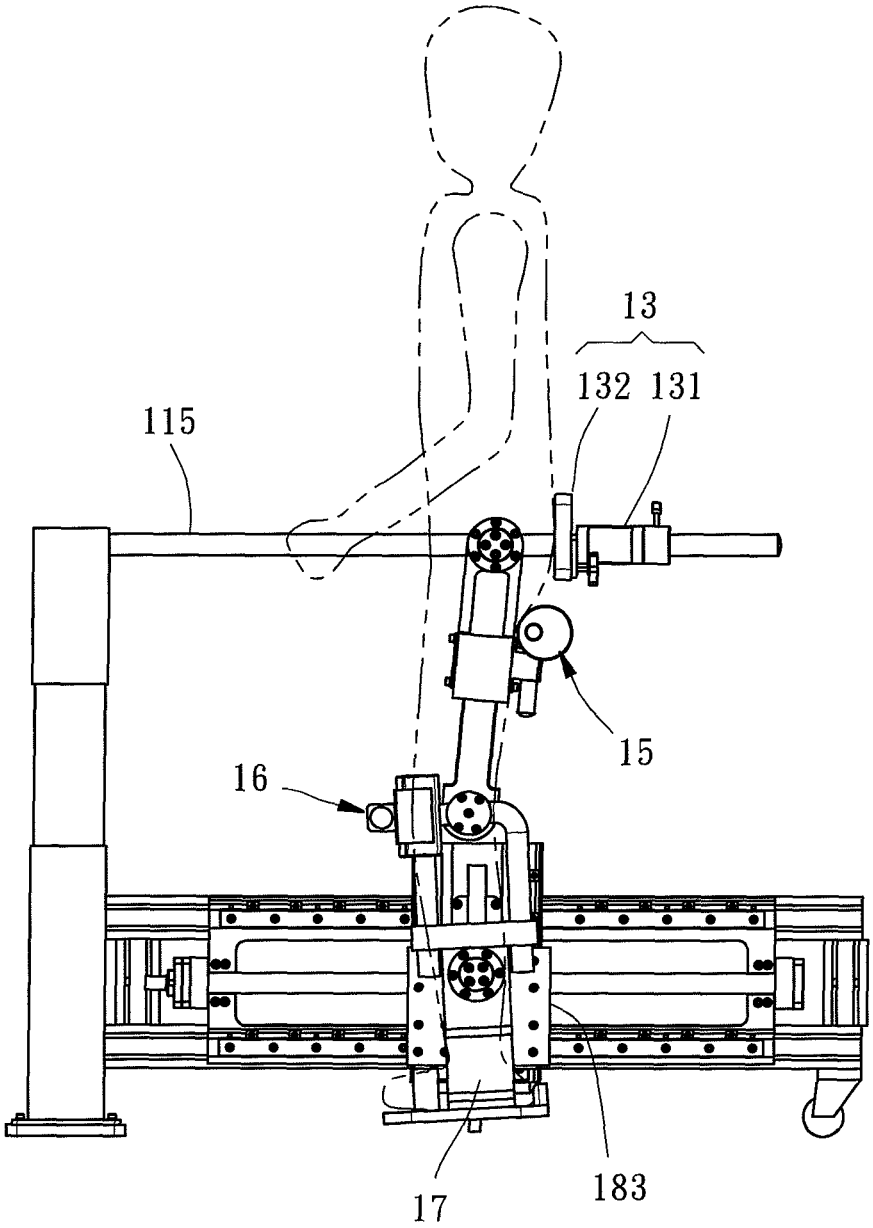
FIG. 14 is another schematic view showing the fourth preferred embodiment of the present invention in use, wherein the patient is engaged in gait rehabilitation exercise.

FIG. 9 and FIG. 10 show the gait rehabilitation machine provided by the third preferred embodiment of the present invention. This gait rehabilitation machine is substantially the same as its counterpart in the first preferred embodiment except that the former further includes a front supporting member 12.

The front supporting member 12 is fixedly and detachably connected to the handrail 115 of the frame 11 so that the front side of the human body can lean against the front supporting member 12. In this preferred embodiment, the front supporting member 12 is of a plate shape. A soft pad 23 made of a soft material is fixedly connected to an edge of the front supporting member 12. The front side of the human body, such as the abdomen or waist, can lean against the soft pad 23.

The operation method of this preferred embodiment is substantially the same as that of the first preferred embodiment except that, in the third preferred embodiment, a patient's front side and back side abut against the front supporting member 12 and the rear supporting member 13 respectively while the patient is standing on the shank supporting member 17. This allows the patient to do gait rehabilitation exercise without having to hold the handrail 115. Besides, the front supporting member 12 in this embodiment doubles as a table, and a patient can lean backward against the rear supporting member 13.

FIG. 11 to FIG. 14 show the gait rehabilitation machine provided by the fourth preferred embodiment of the present invention. This gait rehabilitation machine is substantially the same as its counterpart in the first preferred embodiment except that the former further includes a thigh abutting member 15. The thigh abutting member 15 corresponds to the body portion between the thighs and buttocks and is provided on the frame 11. In this embodiment, the thigh abutting member 15 has a bearing seat 151, a supporting shaft 152, and a roller 153, wherein the bearing seat 151 is fixedly connected to the thigh supporting member 14. While the bearing seat 151 in this embodiment is fixedly connected to the first section 141, it is also feasible to have the bearing seat 151 fixedly connected to the second section 142. The supporting shaft 152 is curved and defines a third section 154 and a fourth section 155. The third section 154 is pivotally connected to the bearing seat 151, thus allowing the supporting shaft 152 to rotate relative to the bearing seat 151. The roller 153 is pivotally connected to the fourth section 155. In this embodiment, the roller 153 has an axis and is pivotally connected to the fourth section 155 in an eccentric manner with respect to the axis. Thus, by rotating the roller 153 to different angles, the tightness with which the roller 153 abuts against a patient's thighs can be adjusted to make the patient feel comfortable.

The operation method of this preferred embodiment is substantially the same as that of the first preferred embodiment except that, once a patient stands on the shank supporting member 17, the supporting shaft 152 can be rotated so that not only does the roller 153 abut against the patient's thighs, but also the tightness with which the roller 153 abuts against the patient's thighs can be adjusted. Consequently, the stability of the patient's thighs during gait rehabilitation exercise is increased.

Figure 15:
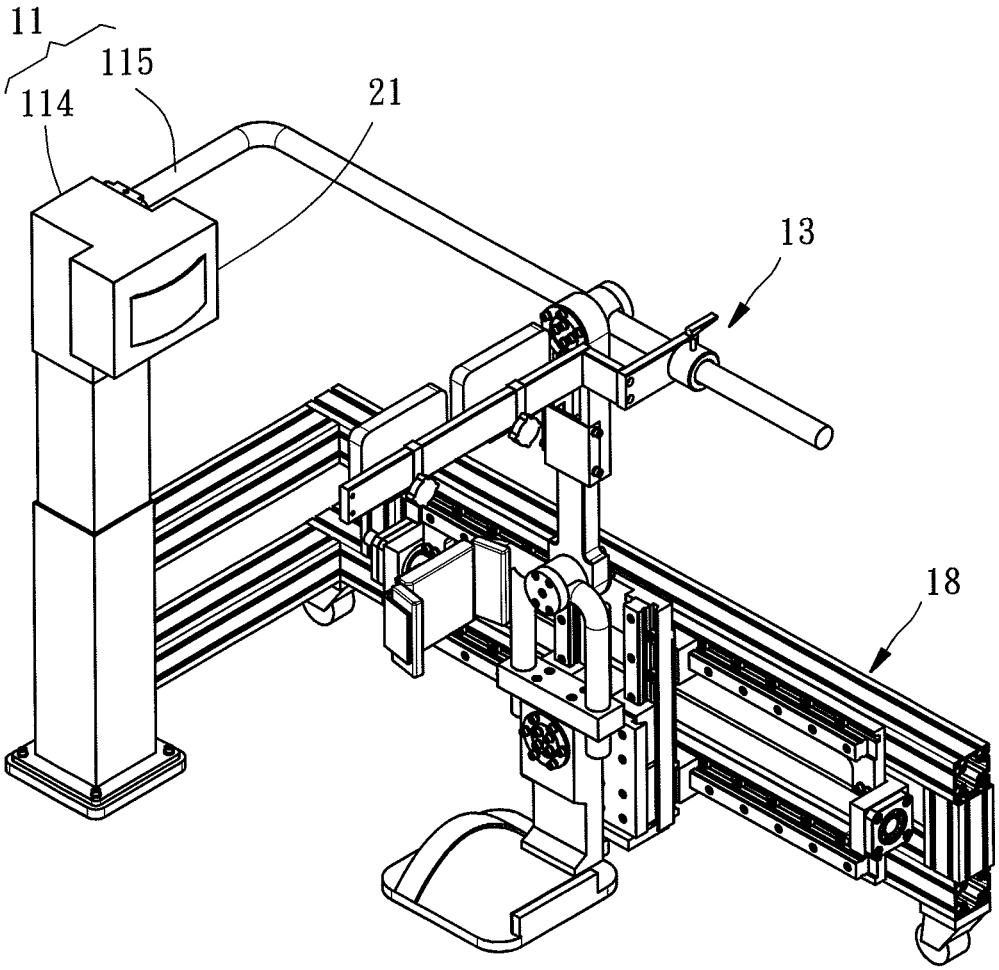
FIG. 15 is a perspective view of the gait rehabilitation machine in the fifth preferred embodiment of the present invention, wherein the gait rehabilitation machine has a reeling device.

FIG. 15 shows the gait rehabilitation machine provided by the fifth preferred embodiment of the present invention. This gait rehabilitation machine is substantially the same as its counterpart in the first preferred embodiment except that the former further includes a reeling device 21 fixedly provided at the frame 11 and in front of the thigh supporting member 14. The reeling device 21 has a winding element 211 wound therein and is configured for increasing or decreasing the exposed length of the winding element 211.

Figure 16:
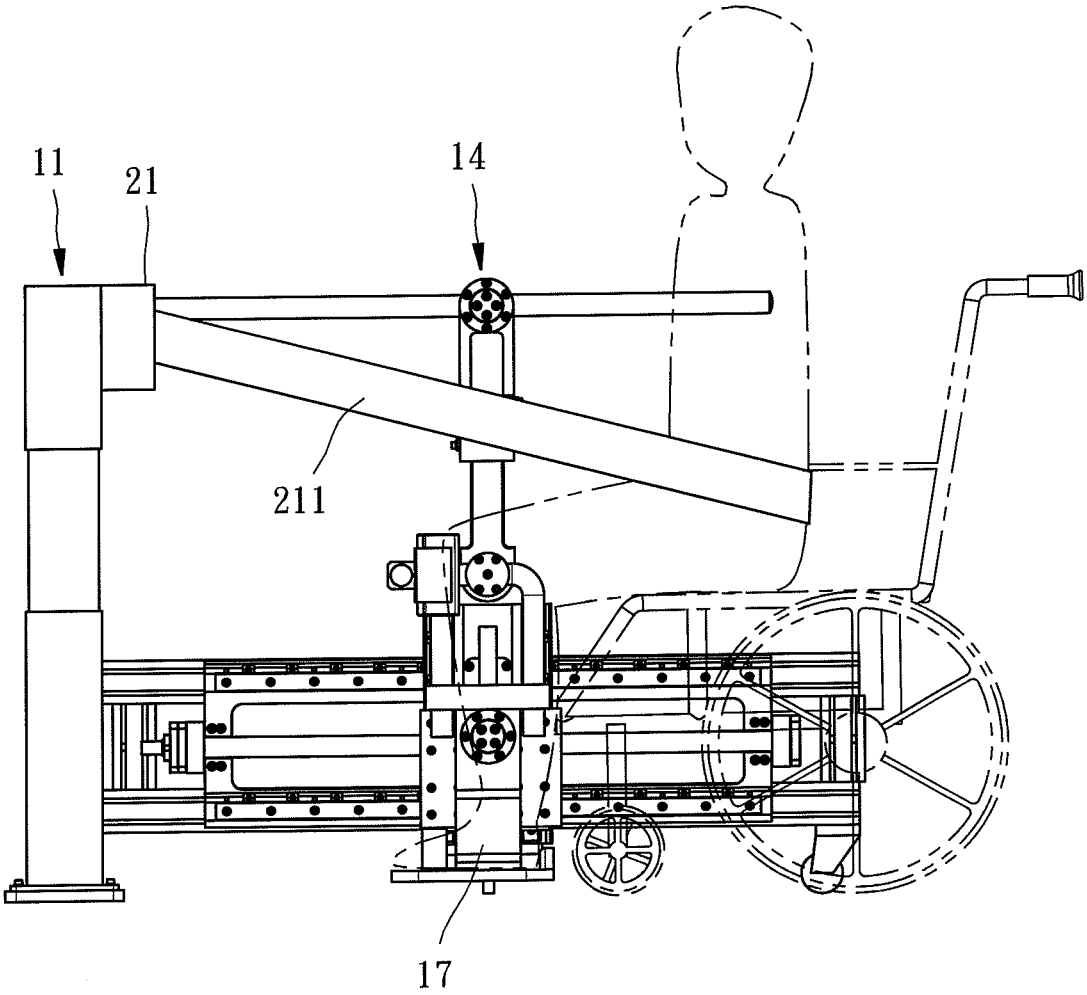
FIG. 16 schematically shows the fifth preferred embodiment of the present invention in use, wherein the reeling device has increased the exposed length of a winding element, allowing the winding element to be wound around a patient's body.
Figure 17:
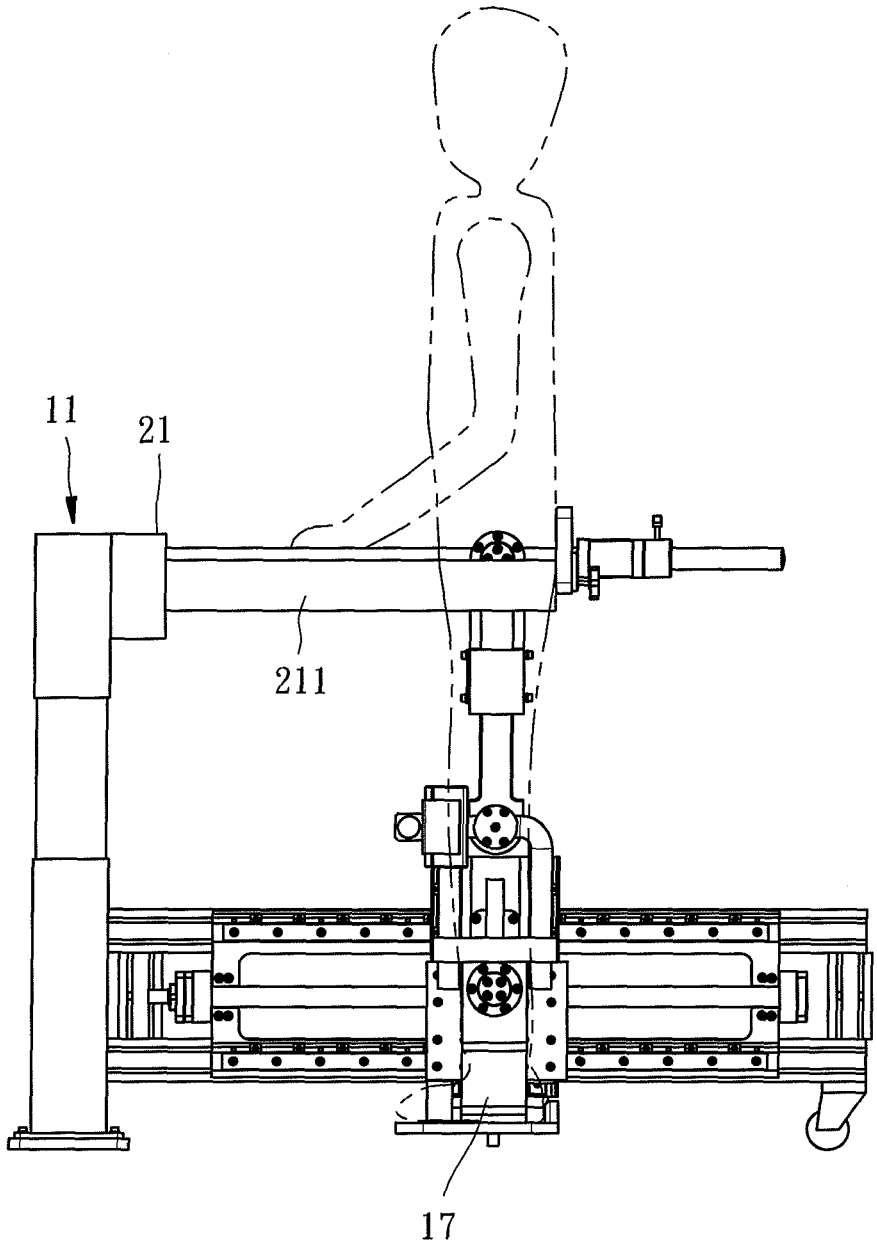
FIG. 17 is another schematic view showing the fifth preferred embodiment of the present invention in use, wherein the reeling device has shortened the exposed length of the winding element such that the patient is driven by the winding element to stand on the shank supporting member on his or her own.
Figure 18:
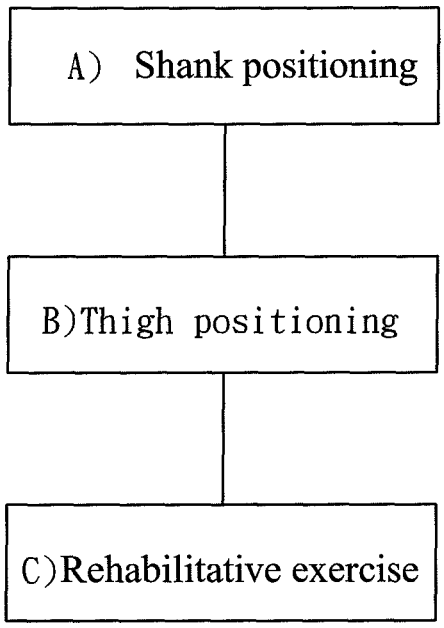
FIG. 18 is a block diagram according to the sixth preferred embodiment of the present invention, showing some steps of use.
Figure 19:
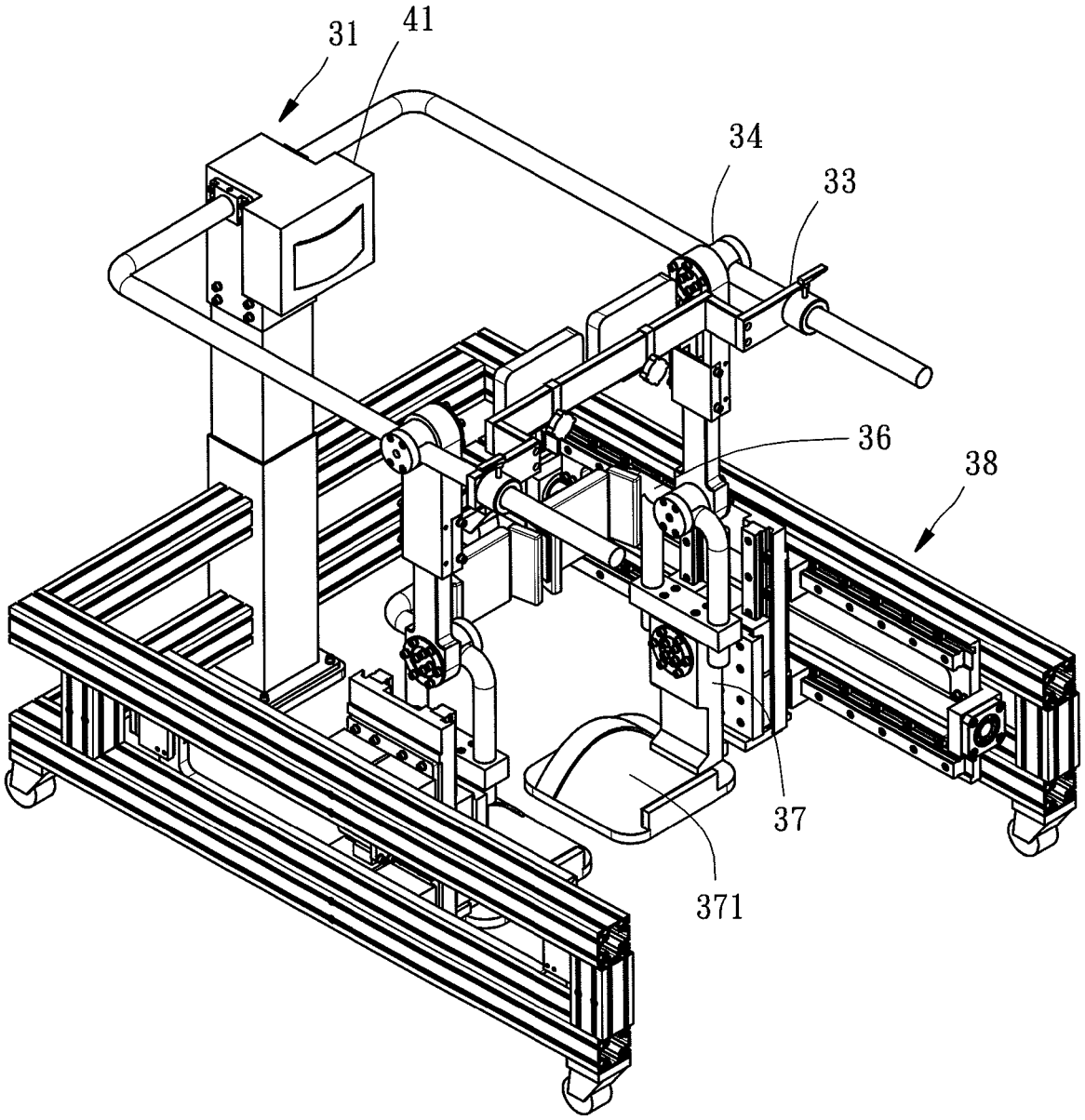
FIG. 19 is a perspective view of the gait rehabilitation machine in the sixth preferred embodiment of the present invention.
Figure 20:
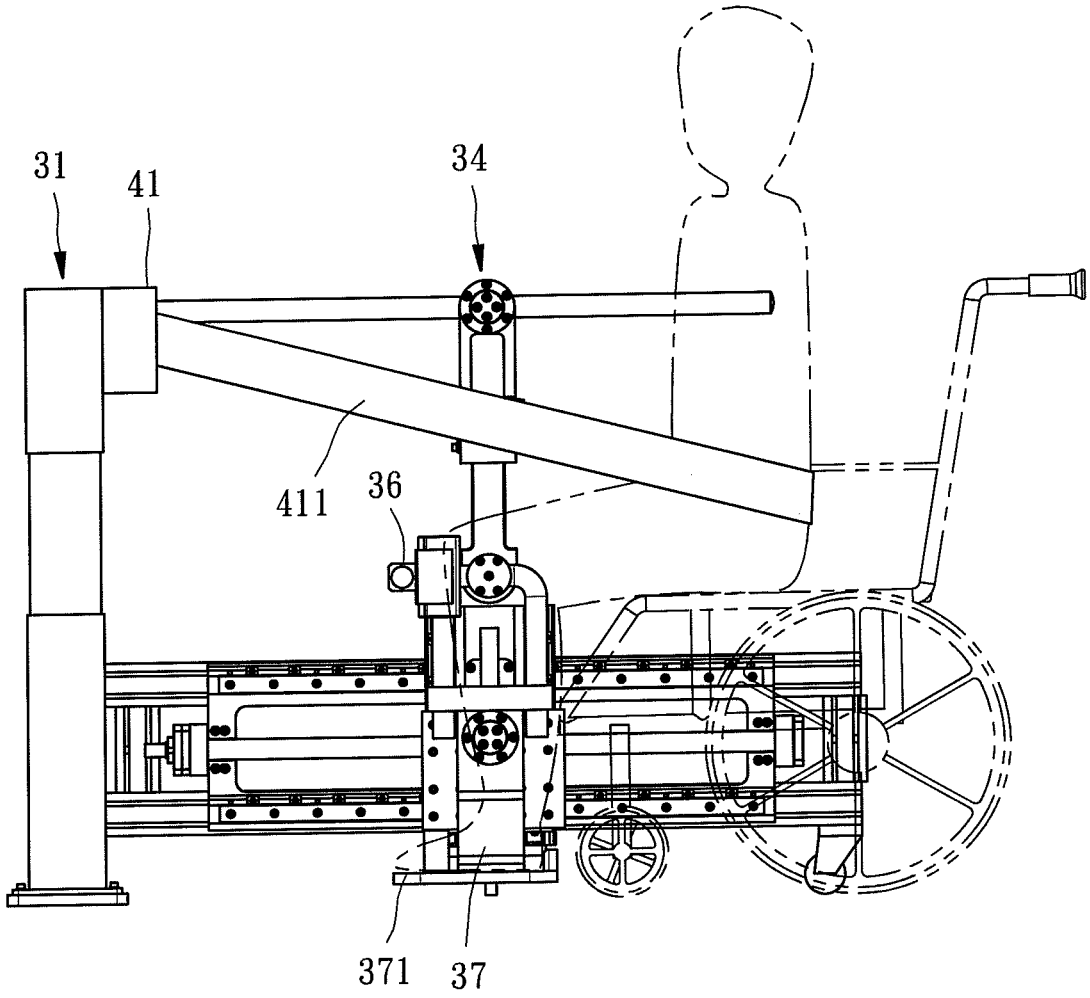
FIG. 20 schematically shows the sixth preferred embodiment of the present invention in use, wherein a wheelchair-ridden patient has entered the gait rehabilitation machine on his or her own or with external help, and then the reeling device increases the exposed length of a winding element, allowing the winding element to be wound around the patient's body.
Figure 21:
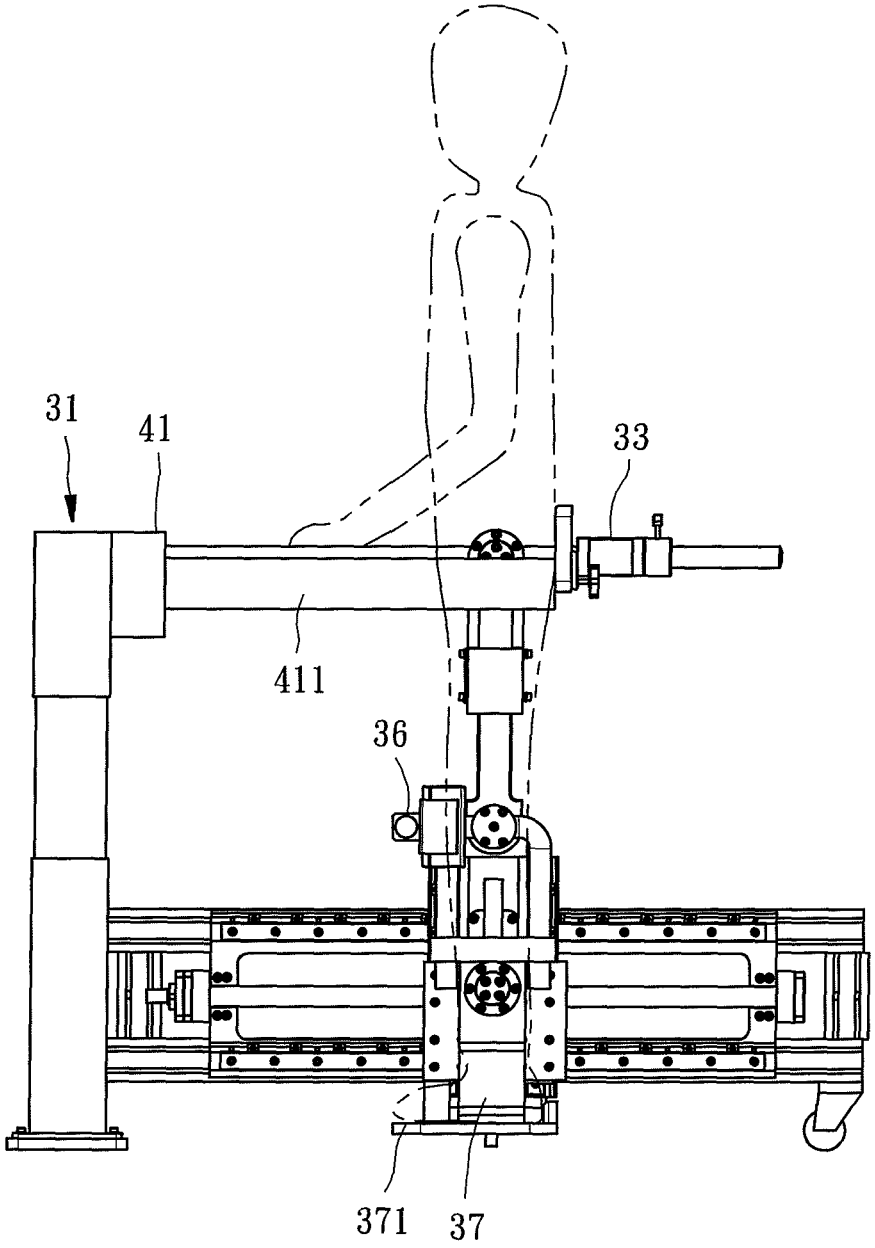
FIG. 21 is another schematic view showing the sixth preferred embodiment of the present invention in use, wherein the reeling device has shortened the exposed length of the winding element such that the patient is driven by the winding element to stand on the shank supporting member.

The method of use of the fifth preferred embodiment is described as follows with reference to FIG. 16 and FIG. 17. In contrast to the first preferred embodiment, in which a patient wishing to use the gait rehabilitation machine needs external help in order to stand on the shank supporting member 17, the fifth preferred embodiment is so designed that, in order for a patient to stand on the shank supporting member 17, the reeling device 21 can be controlled to increase the exposed length of the winding element 211, thus allowing the winding element 211 to be wound around the patient's body. It should be noted that, although the winding element 211 is shown in the drawings as wound around a seated patient's waist, the present invention imposes no limitations in this regard. Following that, the reeling device 21 is controlled to shorten the exposed length of the winding element 211. As a result, the patient is driven by the winding element 211 to stand on the shank supporting member 17 on his or her own. Hence, by operating the reeling device 21, a patient can assume and leave the exercise position in the gait rehabilitation machine without external help. This not only reduces the manpower requirement but also facilitates the execution of gait rehabilitation exercise.

Referring to FIG. 18 to FIG. 21, the sixth preferred embodiment of the present invention provides a method of using a gait rehabilitation machine. The method is directed to a gait rehabilitation machine which includes: a frame 31; a rear supporting member 33 provided at the frame 31 so as for the back side of a human body to lean against the rear supporting member 33; a thigh supporting member 34 corresponding to a thigh of the human body and pivotally connected to the frame 31; a shank supporting member 37 corresponding to the corresponding shank of the human body and provided on the frame 31, wherein the shank supporting member 37 has a pedal 371 to be stepped on by the human body; a knee supporting member 36 corresponding to the corresponding knee of the human body and provided at the thigh supporting member 34 or the shank supporting member 37; a transmission device 38 for driving the shank supporting member 37 to move; and a reeling device 41 fixedly provided at the frame 31 and in front of the thigh supporting member 34, wherein the reeling device 41 has a winding element 411 wound therein and is configured for increasing or decreasing the exposed length of the winding element 411. The method of using the gait rehabilitation machine includes the following steps:

A) Shank positioning: A patient seated in a wheelchair enters the gait rehabilitation machine on his or her own or with external help. Then, the sole of one of the patient's feet is put on the pedal 371, with the corresponding shank placed on the shank supporting member 37.

B) Thigh positioning: The reeling device 41 is controlled so that the winding element 411 is wound around the patient's body. Afterward, the reeling device 41 is controlled to shorten the exposed length of the winding element 411; consequently, the patient is driven by the winding element 411 to stand on the shank supporting member 37, wherein the patient's corresponding thigh corresponds to the thigh supporting members 34 and the patient's corresponding knee corresponds to the knee supporting members 36. In addition, the rear supporting member 33 is assembled onto the frame 31 so as for the patient's back side to lean against the rear supporting member 33.

C) Rehabilitative exercise: The transmission device 38 is operated such that the shank supporting member 37 is driven to move by the transmission device 38. Hence, the patient is engaged in gait rehabilitation exercise.

To sum up, the gait rehabilitation machine and the method of using the same as disclosed herein have the following features:

1. The present invention enables gait rehabilitation with a less bulky machine than in the prior art and eliminates the bodily discomfort of being suspended.

2. By operating the reeling device 21, a patient can take on and leave the exercise position in the gait rehabilitation machine on his or her own. This makes it easier for the patient to engage in rehabilitative exercise than with the prior art assistive apparatuses.

3. By controlling the transmission device 18, the moving path of the shank supporting member can be changed, and hence the patient's lower-limb exercise posture can be adjusted. As a result, the problem of having a fixed lower-limb moving pattern as is commonly seen in the conventional assistive gait rehabilitation apparatuses is solved.

What is claimed is:

1. A gait rehabilitation machine for use in a patient's lower-limb rehabilitation, comprising:

a frame;

a rear supporting member provided at the frame so as for a back side of a human body to lean against the rear supporting member;

a thigh supporting member corresponding to a thigh of the human body and pivotally connected to the frame;

a shank supporting member corresponding to a corresponding shank of the human body and pivotally connected to the thigh supporting member, wherein the shank supporting member has a pedal configured to be stepped on by the human body;

a knee supporting member corresponding to a corresponding knee of the human body and provided at the thigh supporting member, the knee supporting member being pivotally connected to the thigh supporting member and having an abutting portion, configured to be located in front of the human body and configured to abut the knee of the human body; and a transmission device for driving the shank supporting member to move;

wherein the transmission device has a base, a lateral movement device, and a vertical movement device, the base being provided beside the frame, the lateral movement device being provided at the base, located between the base and the frame, and having a lateral movement platform capable of lateral movement, the vertical movement device being installed on the lateral movement platform and having a vertical movement platform capable of vertical movement, the vertical movement platform being pivotally connected to the shank supporting member.

2. The gait rehabilitation machine of claim 1, wherein the frame has a post and a handrail, the post having a bottom portion fixedly provided on a ground or an object, the handrail having an end fixedly connected to the post and an opposite end serving as a free end.

3. The gait rehabilitation machine of claim 2, wherein the post has a fixed element, a movable element, and a lifting unit, the fixed element being provided on the object or the ground, the movable element being movably connected to the fixed element, the lifting unit being fixedly connected to each of the fixed element and the movable element so as to increase or decrease a distance between the fixed element and the movable element.

4. The gait rehabilitation machine of claim 1, wherein the rear supporting member has a fixed bracket and a supporting pad, the fixed bracket being fixedly and detachably connected to the frame, the supporting pad being fixedly provided at the fixed bracket and configured for the back side of the human body to lean against the supporting pad.

5. The gait rehabilitation machine of claim 1, wherein the thigh supporting member has a first section and a second section, the first section being pivotally connected to the frame, the second section being movably connected to the first section.

6. The gait rehabilitation machine of claim 5, wherein the first section is mounted around the second section such that a distance between the first section and the second section is adjustable by moving the first section and the second section relative to each other, thereby adjusting the thigh supporting member to correspond to a dimension of the thigh of the human body.

7. The gait rehabilitation machine of claim 1, wherein a position-limiting element is fixedly provided at the abutting portion and has a position-limiting groove configured for receiving the knee of the human body and thus limiting a moving direction of the knee.

8. A gait rehabilitation machine for use in a patient's lower-limb rehabilitation, comprising:

a frame;

a rear supporting member provided at the frame so as for a back side of a human body to lean against the rear supporting member;

a thigh supporting member corresponding to a thigh of the human body and pivotally connected to the frame;

a shank supporting member corresponding to a corresponding shank of the human body and pivotally connected to the thigh supporting member, wherein the shank supporting member has a pedal configured to be stepped on by the human body;

a knee supporting member corresponding to a corresponding knee of the human body and provided at the shank supporting member; and a transmission device for driving the shank supporting member to move;

wherein the transmission device has a base, a lateral movement device, and a vertical movement device, the base being provided beside the frame, the lateral movement device being provided at the base, located between the base and the frame, and having a lateral movement platform capable of lateral movement, the vertical movement device being installed, on the lateral movement platform and having a vertical movement platform capable of vertical movement, the vertical movement platform being pivotally connected to the shank supporting member;

wherein the shank supporting member is movably connected to the knee supporting member and has a flat plate portion forming the pedal configured to be stepped on by the human body.

9. The gait rehabilitation machine of claim 8, wherein the knee supporting member has a guide post, and the shank supporting member has a guide hole corresponding to the guide post, the guide post being inserted in the guide hole so as to limit relative movement between the knee supporting member and the shank supporting member.

10. The gait rehabilitation machine of claim 8, wherein the flat plate portion has a rear side protrudingly provided with a stop block, there being a strap provided at the flat plate portion and located in front of the stop block.

11. The gait rehabilitation machine of claim 1, further comprising a strap provided on the thigh supporting member.

12. The gait rehabilitation machine of claim 1, wherein the frame has a post, a fixed element, a movable element, a lifting unit, and a handrail, the post being fixedly provided at the base, the fixed element being fixedly provided at the post, the movable element being movably connected to the fixed element, the lifting unit being connected to each of the movable element and the base so as to increase or decrease a distance between the movable element and the base, the handrail being fixedly and detachably connected to the movable element.

13. The gait rehabilitation machine of claim 1, further comprising: a front supporting member provided at the frame so as for a front side of the human body to lean against the front supporting member, the front supporting member being of a plate shape; and a soft pad made of a soft material and fixedly connected to an edge of the front supporting member so as for the front side of the human body to lean against the soft pad.

14. The gait rehabilitation machine of claim 1, further comprising a thigh abutting member corresponding to a portion of the human body that is between the thigh and buttocks, the thigh abutting member being provided on the frame and having a bearing seat, a supporting shaft, and a roller, the bearing seat being provided at the thigh supporting member, the supporting shaft having a curved configuration and defining a seat-connected section and a roller-connected section, the seat-connected section being pivotally connected to the bearing seat, the roller being pivotally connected to the roller-connected section.

15. The gait rehabilitation machine of claim 14, wherein the roller has an axis and is pivotally connected to the fourth section of the supporting shaft in an eccentric manner with respect to the axis.

16. The gait rehabilitation machine of claim 1, further comprising a reeling device fixedly provided at the frame and in front of the thigh supporting member, wherein the reeling device has a winding element wound therein and is configured for increasing or decreasing an exposed length of the winding element.

17. The gait rehabilitation machine of claim 1, wherein the thigh supporting member has a first section and a second section, the first section being pivotally connected to the frame, the second section being movably connected to the first section; the gait rehabilitation machine further comprising a front supporting member provided at the frame so as for a front side of the human body to lean against the front supporting member.

18. A method of using a gait rehabilitation machine, wherein the gait rehabilitation machine comprises: a frame; a rear supporting member provided at the frame so as for a back side of a human body to lean against the rear supporting member; a thigh supporting member corresponding to a thigh of the human body and pivotally connected to the frame; a shank supporting member corresponding to a corresponding shank of the human body and pivotally connected to the thigh supporting member, wherein the shank supporting member has a pedal to be stepped on by the human body; a knee supporting member corresponding to a corresponding knee of the human body and provided at the thigh supporting member the knee supporting member being pivotally connected to the thigh supporting member and having a abutting portion, configured to be located in front of the human body and configured to abut the knee of the human body; a transmission device for driving the shank supporting member to move; wherein the transmission device has a base, a lateral movement device, and a vertical movement device, the base being provided beside the frame, the lateral movement device being provided at the base, located between the base and the frame, and having a lateral movement platform capable of lateral movement, the vertical movement device being installed on the lateral movement platform and having a vertical movement platform capable of vertical movement, the vertical movement platform being pivotally connected to the shank supporting member; and a reeling device fixedly provided at the frame and located in front of the thigh supporting member, wherein the reeling device has a winding element wound therein and is configured for increasing or decreasing an exposed length of the winding element, the method comprising the steps of:

A) shank positioning, in which a patient seated in a wheelchair enters the gait rehabilitation machine on his or her own or with external help, then a sole of one of the patient's feet is placed on the pedal, and a corresponding one of the patient's shanks is placed on the shank supporting member;

B) thigh positioning, in which the reeling device is controlled in such a way that the winding element is wound around the patient's body; then the reeling device is controlled to decrease the exposed length of the winding element such that the patient is driven by the winding element to stand on the shank supporting member, causing a corresponding one of the patient's thighs to correspond to the thigh supporting member, and a corresponding one of the patient's knees to correspond to the knee supporting member; and the rear supporting member is provided at the frame so as for the patient's back side to lean against the rear supporting member; and C) rehabilitative exercise, in which the transmission device is operated to drive the shank supporting member into motion such that the patient is engaged in gait rehabilitation exercise.

* * * * *